US005242221A

United States Patent [19]

Rotthowe

[11] Patent Number: 5,242,221

[45] Date of Patent: Sep. 7, 1993

[54] RUNNER FOR DRAWERS

[76] Inventor: Achim Rotthowe, 253 Hillside Ave., Charlotte, N.C. 28209

[21] Appl. No.: 787,574

[22] Filed: Nov. 4, 1991

[30] Foreign Application Priority Data

Nov. 2, 1991 [DE] Fed. Rep. of Germany ... 9015060[U]

[51] Int. Cl.[5] ..... A47B 88/14

[52] U.S. Cl. ..... 312/334.38; 312/334.5; 384/18; 384/22

[58] Field of Search ..... 312/334.11, 334.31, 312/334.25, 334.33, 334.38, 334.17, 334.5, 330.1, 334.27; 384/18, 22; 403/190, 191, 241, 289

[56] References Cited

U.S. PATENT DOCUMENTS

| | | | |
|---|---|---|---|
| 343,774 | 6/1886 | Moore | 312/334.27 X |
| 2,617,693 | 11/1952 | Stafford | 312/334.27 X |
| 4,778,230 | 10/1988 | Lautenschlager | 312/334.5 |
| 5,020,869 | 6/1991 | Faust . | |

*Primary Examiner*—Kenneth J. Dorner
*Assistant Examiner*—Brian K. Green

[57] ABSTRACT

A reciprocable drawer is guided in a piece of furniture by two runners each of which is adjacent one sidewall of the drawer and includes an elongated rail-shaped horizontal support affixed to the piece of furniture, an elongated follower member in the form of a slide rail which is reciprocably guided by the support, and a bearing member which is affixed to the exposed side of the rear wall of the drawer and has a track for the upper and lateral portions of the rear end portion of the follower member. The bearing member and the follower member of each runner are further provided with complementary male and female guide elements which establish a form-locking connection between the two members and prevent any, or any excessive, lateral stray movements of the follower member relative to the bearing member. The male guide element can include one or more separately produced parts which are welded or otherwise secured to the follower member or to the bearing member, and the female guide element can comprise one or more sockets or slots in the bearing member or in the follower member.

15 Claims, 4 Drawing Sheets

Fig. 4a
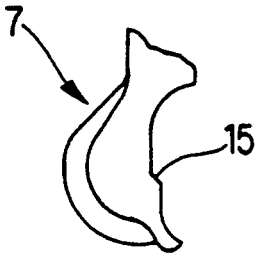
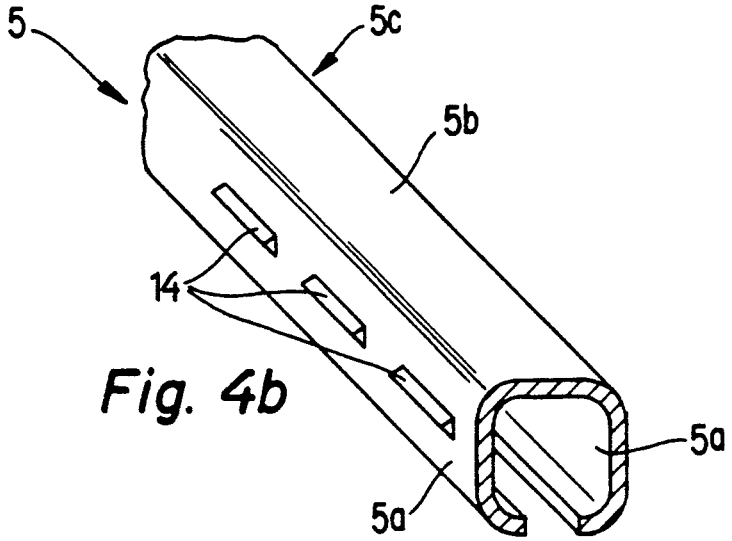
Fig. 4b
Fig. 4c
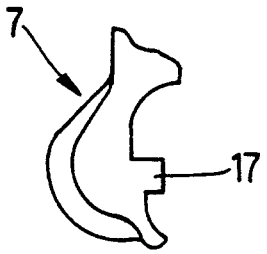
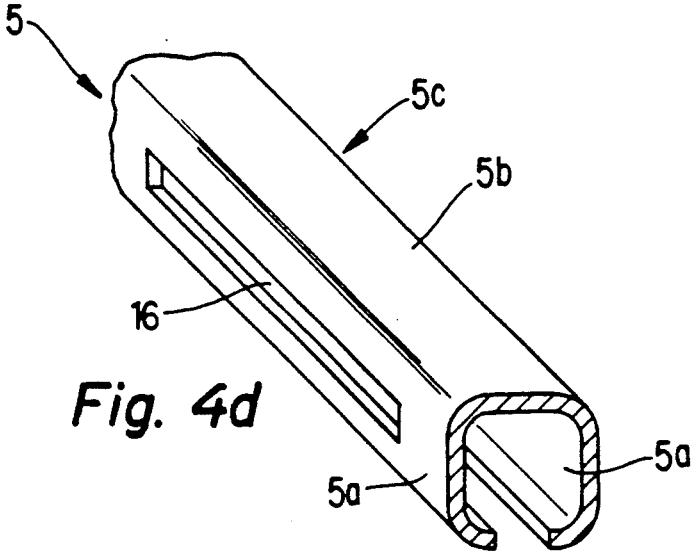
Fig. 4d
Fig. 4e
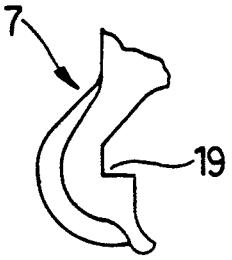
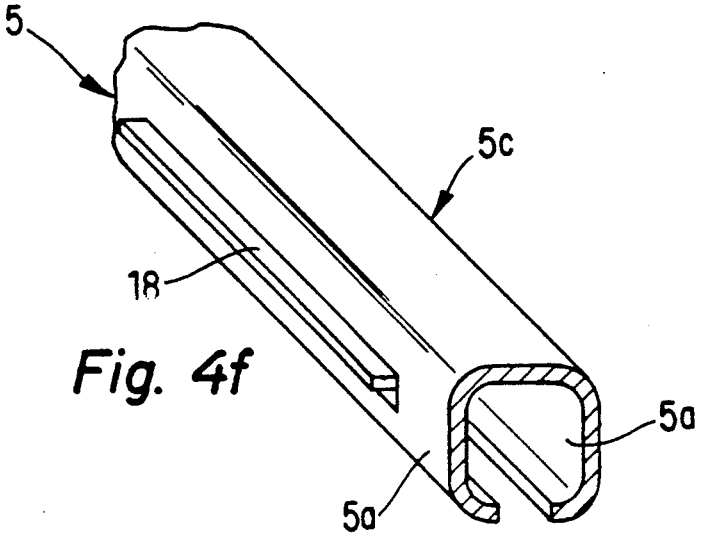
Fig. 4f

RUNNER FOR DRAWERS

BACKGROUND OF THE INVENTION

The invention relates to improvements in hardware for use in connection with drawers which are movably installed in tables, desks, cabinets and/or other pieces of furniture. More particularly, the invention relates to improvements in so-called runners or runner assemblies which are used to ensure predictable reciprocatory movements of drawers relative to pieces of furniture.

It is already known to install a drawer for reciprocatory movement between two runners each of which includes a support affixed to a piece of furniture adjacent one sidewall of the drawer, an elongated follower member (e.g., a slide rail) which is reciprocable along the respective support, and a bearing member which is installed at the rear wall of the drawer and reciprocably receives the rear end portion of the follower member. The front end portion of the follower member is coupled to the drawer so that the follower member is compelled to share the inward as well as outward movements of the drawer. As a rule, the follower member has an elongated leg which extends into an opening of the bearing member on the rear wall of the drawer. A drawback of conventional runners of the above outlined character is that one and the same follower member cannot be used in connection with relatively deep (long) or relatively shallow (short) drawers. Thus, a relatively short follower member might not reach the opening of the bearing member which is affixed to the rear wall of a relatively deep drawer. This renders it necessary to furnish follower members of different lengths. Moreover, the ability of the aforediscussed runners to prevent lateral or sidewise stray movements of the follower members (and hence of the drawer) is rather limited.

In accordance with another earlier proposal, the follower member is assembled of two parts one of which is movable longitudinally of the other part and can be secured to the other part in any one of several positions. This renders it possible to employ a composite follower member in a runner for a shallow drawer or in a runner for a deep drawer. A drawback of this proposal is that the composite follower member is expensive and that its length must be adjusted prior to assembly with other component parts of a runner.

OBJECTS OF THE INVENTION

An object of the invention is to provide a runner which is simpler and less expensive but more versatile than heretofore known runners.

Another object of the invention is to provide a novel and improved bearing member for use in the above outlined runner.

A further object of the invention is to provide a novel and improved follower member for use in the above outlined runner.

An additional object of the invention is to provide a runner which can be put to use, without any modifications, for reliable guidance of shallow (short) or deep (long) drawers.

Still another object of the invention is to provide a novel and improved combination of follower member and bearing member for use in a runner of the above outlined character.

A further object of the invention is to provide a piece of furniture which embodies runners of the above outlined character.

Another object of the invention is to provide a novel and improved combination of a drawer with one or more runners of the above outlined character.

An additional object of the invention is to provide a novel and improved method of assembling the bearing member and the follower member of the above outlined runner.

SUMMARY OF THE INVENTION

The invention is embodied in a runner or runner assembly for a drawer which is reciprocable in predetermined directions relative to a piece of furniture and has a rear wall, a front wall and a pair of sidewalls between the front and rear walls. The improved runner comprises a support which is connectable to the piece of furniture (e.g., to a desk) adjacent one sidewall of the drawer to extend in the predetermined directions, an elongated follower member (e.g., a rail) which is reciprocable along the support and has an upper portion and at least one lateral portion, a bearing member which is connectable to the rear wall of the drawer and includes a track for the upper portion of the follower member, and means for confining the follower member to reciprocatory movements in the predetermined directions relative to the bearing member. The confining means comprises complementary male and female guide elements one of which is provided on the at least one lateral portion of the follower member and the other of which is provided on the bearing member.

The follower member includes an end portion which extends beyond the support and into the track of the bearing member, and the one guide element is provided on such end portion of the follower member. The latter is separably connectable with the drawer, and the male and female guide elements preferably provide a form-locking connection between the two members. The male guide element extends transversely of the end portion of the elongated follower member.

The one guide element can constitute a separately produced part which is bonded and/or otherwise affixed to the at least one lateral portion of the follower member. Alternatively, the one guide element can be of one piece with and can constitute a deformed part of the end portion of the follower member. For example, the one guide element can have an elongated recess in the at least one lateral portion of the follower member.

The bearing member can consist of a single piece of plastic material, and such bearing member preferably consists of two mirror symmetrical halves. As a rule, or at least in many instances, the follower member is reciprocable along a substantially horizontal path upon connection of the support to the piece of furniture, and the two halves of the bearing member are then mirror symmetrical to each other with reference to a vertical plane (which is adjacent the at least one sidewall of the drawer) when the support is properly connected to the piece of furniture and while the bearing member is connected to the rear wall of the drawer and the follower member extends into the track.

The bearing member includes a lower section which is provided with the track, and an upper section, and the runner further comprises means (e.g., one or more threaded fasteners) for separably connecting the upper section of the bearing member to the rear wall of the drawer. Such bearing member preferably further comprises an elastic third section between the upper and lower sections to permit some flexing at the third section with attendant pivotability of the lower section relative to the upper section while the latter is secured to the rear wall of the drawer. The third section can be provided with one or more cutouts (e.g., in the form of through holes or slots or other openings) to enhance its flexibility.

At least one of the upper and lower sections can include locating means to facilitate connection of the bearing member to the rear wall of the drawer in a predetermined position. If each section of the bearing member consists of two mirror symmetrical halves, the locating means can comprise a notch on each half of one of the first and second sections and a projection on each half of the other of the first and second sections.

The track of the bearing member is preferably configurated in such a way that it can receive only the upper portion and a part of or the entire at least one lateral portion of the follower member.

The novel features which are considered as characteristic of the invention are set forth in particular in the appended claims. The improved runner itself, however, both as to its construction and the mode of assembling and using the same, together with additional features and advantages thereof, will be best understood upon perusal of the following detailed description of certain presently preferred specific embodiments with reference to the accompanying drawing.

BRIEF DESCRIPTION OF THE DRAWING

FIG. 4*a* is fragmentary rear elevational view of a modified bearing member;

FIG. 4*b* is a fragmentary perspective view of a follower member having a male guide element complementary to the female guide element of the bearing member of FIG. 4*a;*

FIG. 4*c* is a fragmentary rear elevational view of a third bearing member;

FIG. 4*d* is a fragmentary perspective view of a follower member having a female guide element complementary to the male guide element of the bearing member of FIG. 4*c;*

FIG. 4*e* is a fragmentary rear elevational view of a fourth bearing member;

FIG. 4*f* is a fragmentary perspective view of a follower member having a male guide element complementary to the female guide element of the bearing member of FIG. 4*e;*

DESCRIPTION OF PREFERRED EMBODIMENTS

Figure 1:
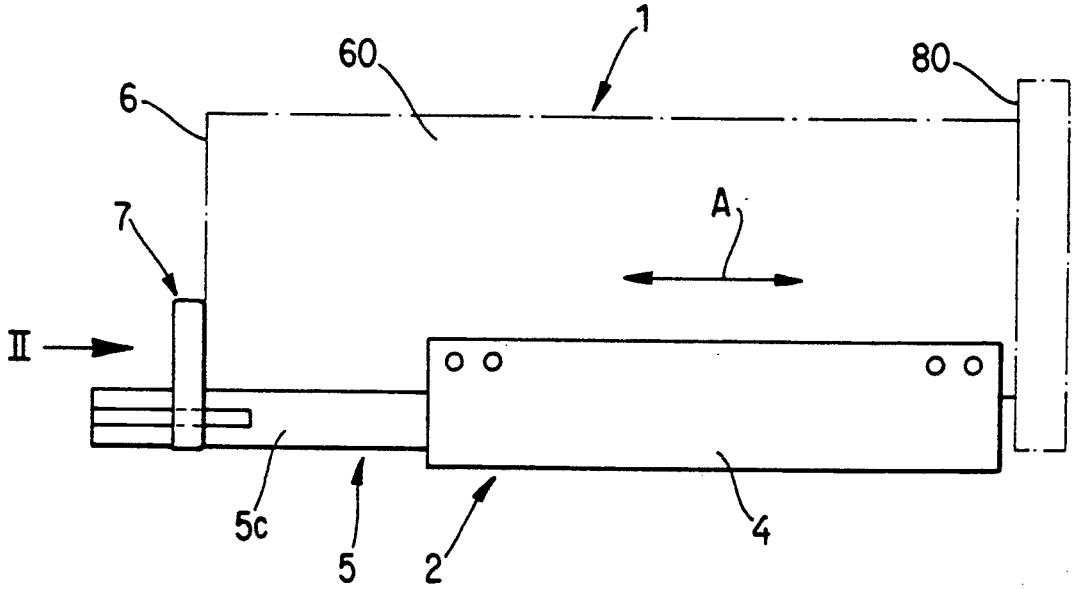
FIG. 1 is a schematic front side elevational view of a runner which embodies one form of the invention, the front and rear walls and one sidewall of a drawer being indicated by phantom lines.
Figure 2:
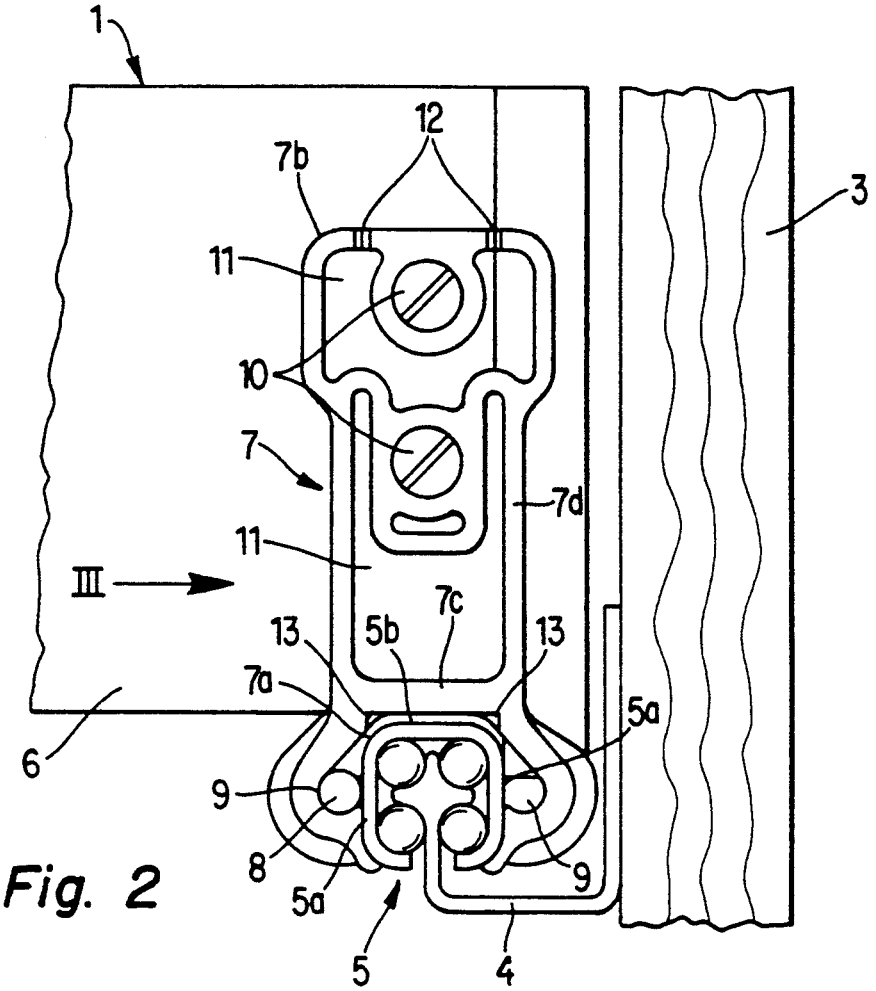
FIG. 2 is an enlarged end elevational view of the runner, substantially as seen in the direction of arrow II in FIG. 1, and further showing a portion of a piece of furniture and a portion of the drawer.
Figure 3:
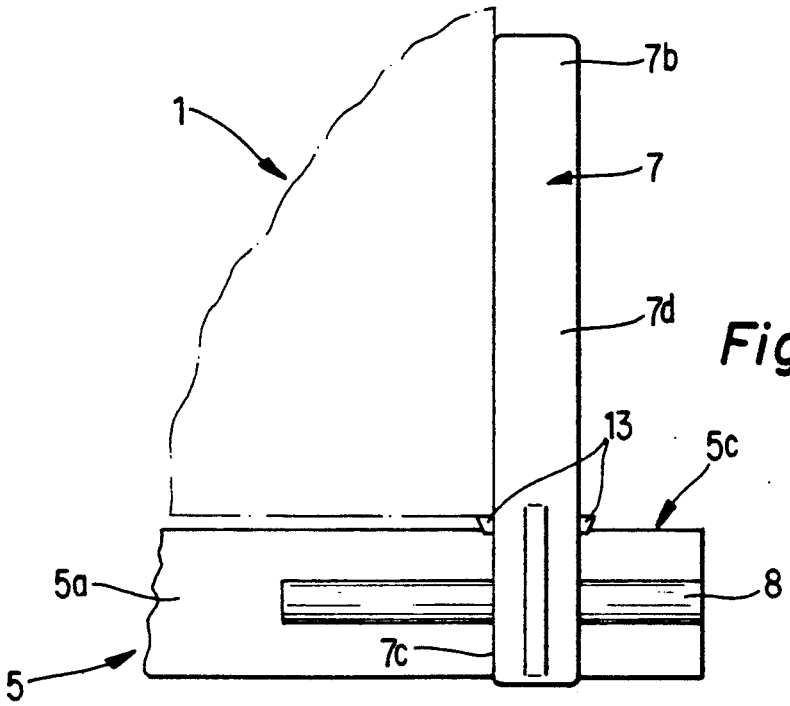
FIG. 3 is a fragmentary rear side elevational view of the runner as seen in the direction of arrow III in FIG. 2, a portion of the drawer being indicated by phantom lines.

Referring first to FIGS. 1 to 3, there is shown a runner 2 which embodies the present invention. The illustrated runner is installed between a piece 3 of furniture (e.g., a table, a desk or a cabinet) and one sidewall 60 of a drawer 1, the latter further having a second sidewall (not shown), a front wall 80 and a rear wall 6. A second runner which is a mirror image of the runner 2 of FIGS. 1 to 3 is installed between the other sidewall of the drawer 1 and the piece 3 of furniture. Reference may be had to commonly owned U.S. Pat. No. 5,020,869 granted Jun. 4, 1991 to Karl-Volker Faust for "Drawer runner for drawers preferably made of plastic" wherein FIG. 1 shows two runners which are mirror images of each other with reference to a vertical plane extending midway between the sidewalls of the drawer.

The runner 2 of FIGS. 1 to 3 comprises an elongated horizontal support 4 in the form of a rail which is separably secured to the piece 3 of furniture adjacent the illustrated sidewall 60 of the drawer 1 and serves to receive and reciprocably guide an elongated follower member 5 in the form of a slide rail. The directions in which the follower member 5 is reciprocable relative to the support 4 are indicated by a double-headed arrow A. A third component of the illustrated runner 2 constitutes a flat upright bearing member 7 of plastic material which is separably connected to the exposed rear side of the rear wall 6 of the drawer 1 and has a lower section 7*c* provided with a track 7*a* for the upper portion 5*b* and the upper parts of the two lateral portions 5*a* of the follower member 5. More specifically, the track 7*a* receives a part of the rear end portion 5*c* of the follower member 5. The upper section 7*b* of the bearing member 7 is separably secured to the rear wall 6 of the drawer 1 by two discrete threaded fasteners 10 or by other suitable connecting means, and the bearing member 7 further includes a flexible third or intermediate portion 7*d* which is disposed between the upper and lower sections 7*b*, 7*c* and has one or more cutouts 11 (e.g., in the form of through holes) which enhance its flexibility and enable the lower section 7*c* to pivot relative to the upper section 7*b*. One or more additional cutouts 11 can be provided in the upper section 7*b* of the bearing member 7.

The follower member 5 can be separably coupled to the adjacent sidewall 60 of the drawer 1. The separable coupling can be of any known design and is preferably provided close to or at the front wall 80. Such coupling prevents any or excessive longitudinal movements of the drawer 1 and follower member 5 relative to each other.

In accordance with a feature of the invention, the runner 2 further comprises a form-locking connection constituting a means for confining the follower member 5 to reciprocatory movements relative to the bearing member 7. The form-locking connection of the runner 2 which is shown in FIGS. 1 to 3 comprises a male guide element 8 at the exposed side of one lateral portion 5*a* of the follower member 5 and a complementary female guide element 9 in the adjacent part of the lower section 7*c* of the bearing member 7. The male guide element 8 is an elongated piece of round wire which is welded or otherwise fixedly connected to the exposed side of the respective lateral portion 5*a* of the rear end portion 5*c* of the follower member 5, and the female guide element 9 is a socket provided in one of two mirror symmetrical prongs which constitute or form part of the lower section 7*c* and define the track 7*a*. The prongs of the lower section 7*c* are at least slightly elastic so that they can bear against the two lateral portions 5*a* of the rear end portion 5*c* when the latter is properly assembled with the bearing member 7. The male guide element 8 projects from the respective lateral portion 5*a* transversely of the longitudinal direction of the follower member 5 and cooperates with the female guide element 9 to prevent any, or any appreciable, lateral or sidewise stray movements of the follower member 5 relative to the bearing member 7 (and hence also any lateral stray movements of the follower member 5 relative to the drawer 1).

The connections between the follower member 5 and the drawer 1 are separable, i.e., the front end portion of the follower member 5 can be uncoupled from the respective sidewall 60 and/or from the front wall 80 of the drawer, and the rear end portion 5*c* of the follower member 5 can be disengaged from the lower section 7*c* of the bearing member 7, or the bearing member 7 and the follower member 5 can be detached from the drawer by removing the shanks of the threaded fasteners 10 from the rear wall 6.

An advantage of the feature that the lower part of the follower member 5 is not or need not be completely surrounded by the bearing member 7 is that the improved runner 2 can be utilized in pieces of furniture wherein the drawer can be completely withdrawn from its compartment.

The socket 9 is preferably bounded by a rounded surface with a radius of curvature which equals or approximates the radius of the wire-like male guide element 8.

Some flexibility of the bearing member 7 is desirable and advantageous in order to permit some compensation for manufacturing tolerances and/or for departures of mounting of the member 5 and/or 7 in an optimum position relative to the drawer 1. Such flexibility can be attributable to innate elasticity of the plastic material of the bearing member 7 and/or to the aforediscussed configuration of the third or intermediate section 7*d* of the bearing member.

The illustrated bearing member 7 comprises two halves which are mirror images of each other with reference to a vertical plane which includes the axes of the threaded fasteners 10. Thus, each of the three sections 7*b*, 7*c*, 7*d* of the bearing member 7 comprises two halves which are mirror images of each other with reference to the afore-discussed vertical plane. Such vertical plane is parallel to the plane of the adjacent sidewall 60 of the drawer 1 and is normal to the plane of the rear wall 6 or front wall 80. FIG. 3 shows that the bearing member 7 is a flat body located in a plane which is normal to the follower member 5. Due to its symmetrical design, the illustrated bearing member 7 can be put to use at either side of the drawer 1, i.e., it suffices to mass produce a single type of bearing members for use in left-hand as well as in right-hand runners for drawers 1 or for similar drawers. In other words, the illustrated bearing member 7 can be inverted and separably affixed to the rear wall 6 of the drawer 1 in such inverted position.

The bearing member 7 further comprises locating means to facilitate its connection to the rear wall 6 in a predetermined optimum position. Such locating means comprises two notches 12 which are provided in the two mirror symmetrical halves of the upper section 7*b*, and two projections 13 which are provided on the two mirror symmetrical halves of the lower section 7*c* of the bearing member 7. Actually, the bearing member 7 comprises a pair of notches 12 and a pair of projections 13 at each of its sides (FIG. 3 shows one projection 13 of each of the two pairs of such projections).

The follower member 5 can be provided with two wire-like male guide elements 8 each of which extends into a discrete female guide element or socket 9 of the lower section 7*c* of the bearing member 7. As mentioned above, the two prongs of the track 7*a* of the lower section 7*c* preferably engage the adjacent lateral portions 5*a* of the follower member 5 with a certain amount of friction, i.e., they can bear against the adjacent lateral portions 5*a* with a certain force to even further reduce the likelihood of stray movements of the follower member 5 transversely of and relative to the bearing member 7 and drawer 1.

FIGS. 4*a* and 4*b* show a portion of a modified bearing member 7 and a portion of a modified follower member 5. The lateral portions 5*a* of the rear end portion 5*c* of the follower member 5 are of one-piece with elongated rib-shaped male detent elements 14 which constitute outwardly depressed parts of the respective lateral portions 5*a* and cooperate with female guide elements in the form of sockets 15 (only one shown in FIG. 4*a*) of the corresponding bearing member 7. The illustrated male guide element 14 includes three aligned components.

FIG. 4*d* shows that the lateral portions 5*a* of the rear end portion 5*c* of the follower member 5 can be provided with female guide elements in the form of longitudinally extending slots or recesses 16 (one shown) which can receive complementary male guide elements 17 of the respective prongs on the lower section of the associated bearing member 7 (see FIG. 4*c*). In other words, the male guide element can be provided on the follower member 5 or on the bearing member 7, and the female guide element can be provided on the bearing member 7 or on the follower member 5.

FIG. 4*f* shows the rear end portion 5*c* of a follower member 5 wherein the lateral portions 5*a* are of one piece with elongated rib-shaped or web-shaped male guide elements 18 (one shown) which can be obtained by providing the lateral portions 5*a* with U-shaped slits and by bending the material within such slits outwardly beyond the exposed sides of the respective lateral portions. One of the complementary female guide elements 19 is shown in FIG. 4*e*.

Figure 4G:
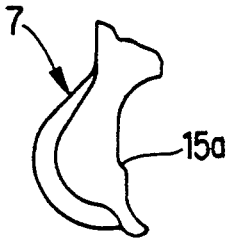
FIG. 4*g* is a fragmentary rear elevational view of a fifth bearing member.
Figure 4H:
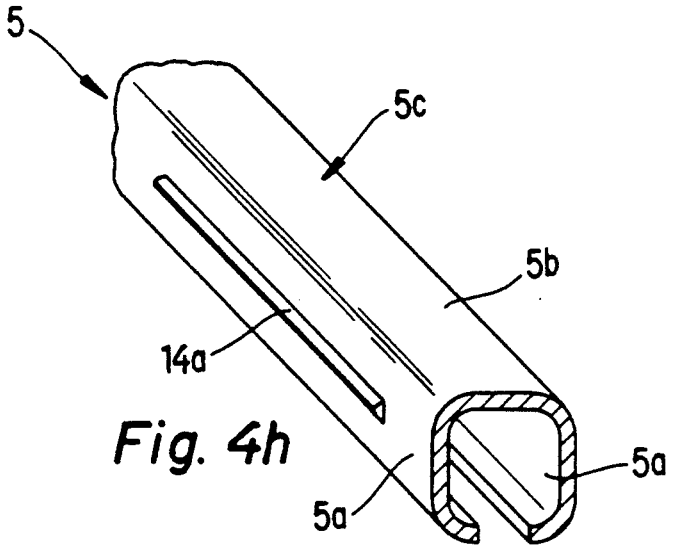
FIG. 4*h* is a framentary perspective view of a follower member having a male guide element complementary to the female guide element of the bearing member of FIG. 4*g;*
Figure 5A:
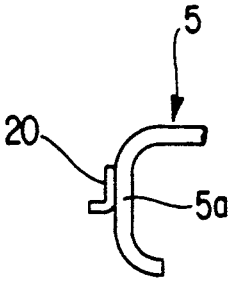
FIG. 5*a* is a fragmentary end elevational view of a follower member with a first separately produced male guide element.
Figure 5B:
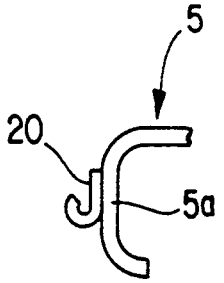
FIG. 5*b* is a fragmentary end elevational view of a follower member with a second separately produced male guide element.
Figure 5C:
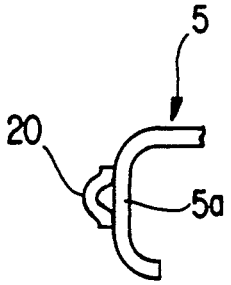
FIG. 5*c* is a fragmentary end elevational view of a follower member with a third separately produced male guide element.
Figure 5D:
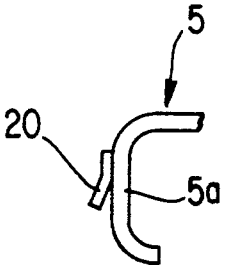
FIG. 5*d* is a fragmentary end elevational view of a follower member with a fourth separately produced male guide element.
Figure 5E:
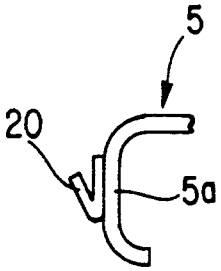
FIG. 5*e* is a fragmentary end elevational view of a follower member with a fifth separately produced male guide element.

FIG. 4*h* shows the rear end portion 5*c* of a follower member 5 wherein the lateral portions 5*a* are provided with male guide elements 14*a* in the form of elongated one-piece protuberances (only one shown) which can be obtained by displacing a certain part of each lateral portion 5*a* outwardly so as to impart to the male detent elements 14*a* a substantially semicircular cross-sectional outline. The complementary female guide element or socket 15*a* is shown in FIG. 4*g*.

FIGS. 5*a* to 5*e* show five separately produced male guide elements 20 which are welded or otherwise affixed to the outer sides of the respective lateral portions 5*a*. Each follower member 5 preferably carries two mirror symmetrical separately produced male guide elements 20 of the type shown in FIG. 5*a*, 5*b*, 5*c*, 5*d* or 5*e*. The configuration of the complementary female detent elements (not shown) is such that they can snugly receive the respective separately produced male detent elements 20. In all instances, the male and the complementary female guide elements preferably extend transversely of the longitudinal direction of the respective follower member 5.

An important advantage of the improved runner is that it can be utilized with equal advantage in conjunction with shallow (short) or deep (long) drawers. All that is necessary is to properly select the length of the end portion 5*c*, i.e., to provide the lateral portions 5*a* with male or female guide elements which are sufficiently long to ensure proper engagement with the complementary female or male guide elements of a bearing member 7 which is affixed to the rear wall of a short, medium, long or very long drawer. The rear end portion 5*c* of the follower member 5 enters the track 7*a* of the corresponding bearing member 7 not later than in response to partial depression of the drawer into the piece of furniture. At the same time the front end portion of the follower member 5 is movably or fixedly coupled to the respective sidewall and/or to the front wall of the drawer.

Another important advantage of the improved runner is that it suffices to provide a one-piece follower member 5 irrespective of the length or depth of the drawer.

A further important advantage of the improved runner is that lateral stray movements of the follower member 5 relative to the bearing member 7 are prevented or adequately limited in a simple and inexpensive manner, i.e., by providing the lateral portion(s) of the follower member with preferably integral male or female guide element(s).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A runner for a drawer which is reciprocable in predetermined directions relative to a piece of furniture and has a rear wall, a front wall and a pair of sidewalls between the front and rear walls, said runner comprising a support for being connected to the piece of furniture adjacent one sidewall of the drawer to extend in said directions; an elongated follower member reciprocable along said support and having an upper portion and at least one lateral portion; a bearing member for being connected with the rear wall of the drawer and including a track for said upper portion; and means for confining said follower member to reciprocatory movements in said directions relative to said bearing member between a plurality of positions, said confining means comprising complementary male and female guide elements one of which is provided on said at least one lateral portion and the other of which is provided on said bearing member, said male and female guide elements providing a form-locking connection between said members in a selected position of said follower member relative to said bearing member; and wherein the one of the male and female guide elements provided on the said at least one lateral portion extends along the elongated follower member in said predetermined direction substantially further than said bearing member to provide a means for allowing said bearing member to be adjusted along the elongated follower member.

2. The runner of claim 1, wherein said follower member includes an end portion extending beyond said support and into said track, said one guide element being provided on the end portion of said follower member.

3. The runner of claim 2, wherein said male guide element extends transversely of said end portion of said elongated follower member.

4. The runner of claim 3, wherein said one guide element is a separately produced part which is affixed to said at least one lateral portion of said follower member.

5. The runner of claim 3, wherein said one guide element is of one piece with and constitutes a deformed part of said end portion.

6. The runner of claim 3, wherein said one guide element is an elongated recess in said at least one lateral portion of said follower member.

7. The runner of claim 3, wherein said bearing member consists of a single piece of plastic material.

8. The runner of claim 3, wherein said bearing member consists of two mirror symmetrical halves.

9. The runner of claim 8, wherein said follower member is reciprocable along a substantially horizontal path upon connection of said support to the piece of furniture and said halves of said bearing member are mirror symmetrical to each other with reference to a vertical plane upon connection of said support to the piece of furniture and while said bearing member is connected to the rear wall of the drawer and said follower member extends into said track.

10. The runner of claim 3, wherein said bearing member includes a lower section which is provided with said track and an upper section, and further comprising means for separably connecting the upper section of said bearing member to the rear wall of the drawer.

11. The runner of claim 10, wherein said bearing member includes an elastic third section between said upper and lower sections.

12. The runner of claim 11, wherein said third section has at least one cutout.

13. The runner of claim 3, wherein said bearing member comprises an upper section which is connectable to the rear wall of the drawer and a lower section which is provided with said track, at least one of said sections including locating means which facilitates connection of said bearing member to the rear wall of the drawer in a predetermined position.

14. The runner of claim 13, wherein each of said sections consists of two substantially mirror symmetrical halves, said locating means comprising a notch in each half of one of said sections and a projection on each half of the other of said sections.

15. The runner of claim 13, wherein said track is configurated to receive only said upper portion and at least a part of the at least one lateral portion of said follower member.

* * * * *

UNITED STATES PATENT AND TRADEMARK OFFICE

CERTIFICATE OF CORRECTION

PATENT NO. : 5,242,221

DATED : September 7, 1993

INVENTOR(S) : Achim ROTTHOWE

It is certified that error appears in the above-identified patent and that said Letters Patent is hereby corrected as shown below:

On title page, item

[30] Foreign Application Priority Data: "Nov. 2, 1991" should read --Nov. 2, 1990--.

[73] Assignee: --Paul Hettich GmbH & Co.-- was omitted and should be added.

Signed and Sealed this

Third Day of May, 1994

Bruce Lehman

*Attest:*

BRUCE LEHMAN

*Attesting Officer*

*Commissioner of Patents and Trademarks*